US011268674B2

(12) United States Patent
Drueppel et al.

(10) Patent No.: US 11,268,674 B2
(45) Date of Patent: Mar. 8, 2022

(54) HEADLIGHT FOR A VEHICLE WITH A COOLING DEVICE FOR A SEMICONDUCTOR ILLUMINANT

(71) Applicant: HELLA GMBH & CO. KGAA, Lippstadt (DE)

(72) Inventors: Mathias Drueppel, Lippstadt (DE); David Duhme, Lippetal (DE); Bernd Fischer, Altenbeken (DE); Marc Kaup, Paderborn (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/943,700

(22) Filed: Jul. 30, 2020

(65) Prior Publication Data

US 2020/0355341 A1 Nov. 12, 2020

Related U.S. Application Data

(63) Continuation of application No. PCT/EP2019/051151, filed on Jan. 17, 2019.

(30) Foreign Application Priority Data

Jan. 30, 2018 (DE) ..... 10 2018 101 988.2

(51) Int. Cl.

| | |
|---|---|
| ***F21S 45/46*** | (2018.01) |
| ***F21V 29/51*** | (2015.01) |
| *F21Y 115/00* | (2016.01) |

(52) U.S. Cl.

CPC ..... *F21S 45/46* (2018.01); *F21V 29/51* (2015.01); *F21Y 2115/00* (2016.08)

(58) Field of Classification Search

CPC ..... F21S 41/141; F21S 45/46; F21V 29/51; F21Y 2115/00

See application file for complete search history.

(56) References Cited

U.S. PATENT DOCUMENTS

| | | | | |
|---|---|---|---|---|
| 8,851,154 | B2 | 10/2014 | Cheng et al. | |
| 2006/0285331 | A1* | 12/2006 | Wang | F21V 29/56 362/294 |
| 2008/0175008 | A1* | 7/2008 | Hu | F21V 29/51 362/373 |

(Continued)

FOREIGN PATENT DOCUMENTS

| | | | |
|---|---|---|---|
| DE | 10 2006 010 977 | A1 | 12/2007 |
| DE | 10 2007 038 909 | A1 | 2/2009 |

(Continued)

*Primary Examiner* — Zheng Song

(74) *Attorney, Agent, or Firm* — Muncy, Geissler, Olds & Lowe, P.C.

(57) ABSTRACT

A headlight for a vehicle with a cooling device for a semiconductor illuminant, wherein the cooling device comprises a fluid circuit with an evaporator, on or in which the semiconductor illuminant is arranged and a cooling medium can be evaporated, and wherein the cooling device further comprises a condenser on or in which the cooling medium can be condensed. The cooling medium comprises a first coolant, which has a first lower evaporation temperature and the cooling medium comprises a second coolant, which has a second higher evaporation temperature.

10 Claims, 1 Drawing Sheet

(56) References Cited

U.S. PATENT DOCUMENTS

| | | | | |
|---|---|---|---|---|
| 2009/0126905 | A1* | 5/2009 | Dinh | F21K 9/00 165/104.33 |
| 2009/0213613 | A1 | 8/2009 | Mitic et al. | |
| 2011/0157910 | A1* | 6/2011 | Shen | F21V 29/56 362/547 |
| 2011/0193479 | A1* | 8/2011 | Nilssen | F21V 23/0492 315/35 |
| 2011/0280033 | A1* | 11/2011 | Kishimoto | F21S 41/16 362/543 |
| 2012/0026745 | A1* | 2/2012 | Cheng | F21V 29/51 362/373 |
| 2014/0071707 | A1* | 3/2014 | Booker | F21S 45/465 362/545 |
| 2016/0356551 | A1 | 12/2016 | Lan | |
| 2018/0246550 | A1* | 8/2018 | Inaba | G06F 1/206 |

FOREIGN PATENT DOCUMENTS

| | | | | |
|---|---|---|---|---|
| DE | 10 2007 038 911 | A1 | 2/2009 | |
| DE | 20 2015 100 296 | U1 | 6/2015 | |
| DE | 10 2014 219 207 | A1 | 3/2016 | |
| EP | 1 491 608 | A1 | 12/2004 | |
| EP | 2 413 030 | A2 | 2/2012 | |
| FR | 3 010 490 | A1 | 3/2015 | |
| JP | 2011-243375 | A | 12/2011 | |
| KR | 100970224 | * | 7/2010 | F21V 29/59 |
| WO | WO 2006/052022 | A1 | 5/2006 | |

* cited by examiner

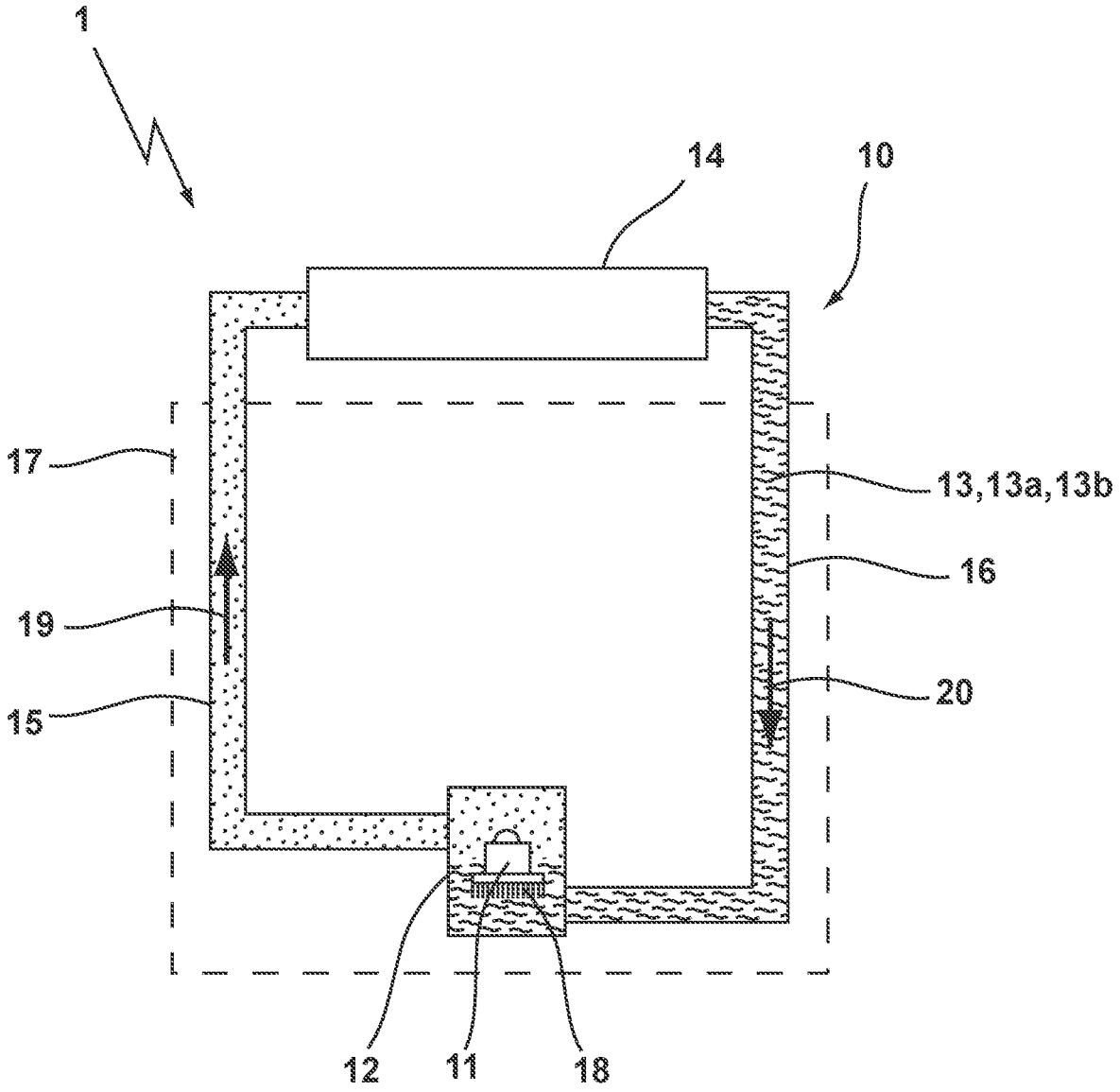
1
14
10
17
13,13a,13b
16
19
20
15
12
11
18

HEADLIGHT FOR A VEHICLE WITH A COOLING DEVICE FOR A SEMICONDUCTOR ILLUMINANT

This nonprovisional application is a continuation of International Application No. PCT/EP2019/051151, which was filed on Jan. 17, 2019, and which claims priority to German Patent Application No. 10 2018 101 988.2, which was filed in Germany on Jan. 30, 2018, and which are both herein incorporated by reference

BACKGROUND OF THE INVENTION

Field of the Invention

The present invention relates to a headlight for a vehicle with a cooling device for a semiconductor illuminant, wherein the cooling device comprises a fluid circuit with an evaporator, on or in which the semiconductor illuminant is arranged and a cooling medium can be evaporated, and wherein the cooling device further comprises a condenser on or in which the cooling medium can be condensed.

Description of the Background Art

DE 10 2006 010 977 A1, which corresponds to US 2009/0213613, discloses a headlight for a vehicle with a cooling device, which serves to cool a semiconductor illuminant included in the headlight. The cooling device has a fluid circuit with an evaporator and with a condenser, and such a cooling device is also referred to as a thermosiphon. The cooling circuit is filled with a cooling medium that can evaporate in the evaporator, wherein the heat of evaporation is generated by the operation of the semiconductor illuminant, which has to be cooled. The evaporation of the cooling medium, i.e. the transfer from a liquid to a gaseous state, requires a high enthalpy of evaporation, so that, by means of the phase transition, a large amount of heat of the semiconductor illuminant can be transferred to the cooling medium. In particular, the semiconductor illuminant can be cooled isothermally, in particular when the evaporation temperature of the cooling medium in the evaporator has been reached. For this purpose, the cooling medium is introduced to the evaporator in a liquid state, and the cooling medium evaporates on the semiconductor illuminant or on a body, via which the heat of the semiconductor illuminant is discharged to the cooling medium. The gaseous cooling medium in the evaporated state thereby passes from the evaporator to the condenser, which is arranged at a remote location from the evaporator. The condenser is used to return the cooling medium from the gaseous state to the liquid state, and the cooling medium can eventually be re-introduced to the evaporator in a liquid state. A closed fluid circuit is thus set up, with which larger amounts of heat can be conducted from the semiconductor illuminant to the condenser.

However, if the semiconductor illuminant is operated at temperatures above the evaporation temperature of the cooling medium, the evaporation enthalpy can no longer be used for the phase transition from the liquid to the gaseous state of the cooling medium, so that the required cooling of the semiconductor illuminant no longer works. In particular, the cooling device would have to be dimensioned larger to ensure adequate cooling of the semiconductor illuminant.

SUMMARY OF THE INVENTION

It is therefore an object of the present invention to provide a headlight with an improved cooling device based on a two-phase cooling principle with an evaporator and a condenser, wherein a phase transition of a cooling medium is to be used in an improved manner for cooling.

The invention includes the technical teaching that the cooling medium comprises a first coolant, which has a first lower evaporation temperature and that the cooling medium comprises a second coolant, which has a second higher evaporation temperature.

In an exemplary embodiment, it is an object to provide at least one cooling medium with a first coolant, which has an evaporation temperature which lies below a nominal operating temperature of the semiconductor illuminant, and a second coolant is to be used, which lies below a damage temperature of the semiconductor illuminant. The first coolant can thus be used for the normal operation of the semiconductor illuminant and evaporate below the operating temperature of the illuminant, which can take place as the standard or continuous operation of the headlight. Should the temperature of the semiconductor illuminant be above the nominal operating temperature, for example, due to a very high ambient temperature, strong solar radiation into the headlight or the like, the second coolant can be used, whereas the first coolant has already evaporated, so that the second coolant reaches the evaporation temperature only at this point.

With particular advantage, the first coolant and the second coolant form a mixture. For the purpose of the present invention, the cooling device can also have two separate fluid circuits, wherein the first coolant in the first fluid circuit and the second coolant in the second fluid circuit can be guided between the evaporator and the condenser.

With particular advantage, the first coolant has an evaporation temperature which is below a nominal operating temperature of the semiconductor illuminant, for example 1° C. to 5° C. The second coolant can have an evaporation temperature that is below a damage temperature of the semiconductor illuminant, for example 1° C. to 5° C. or, for example, 1° C. to 10° C. Due to the inventive development of the cooling device for a headlight, temperature-related damage to the semiconductor illuminant is likely avoided.

A further advantage is that at least one of the coolants has a perfluorinated chemical compound, which is derived from an ethyl isopropyl ketone. Such cooling mediums are known, for example, under the trade name NOVEC from the company 3M.

A further advantage is obtained if a steam line extends between the evaporator and the condenser, via which the coolants can be conducted from the evaporator to the condenser, and wherein a liquid line extends from the condenser to the evaporator, through which the coolants can be conducted from the condenser the evaporator. The steam line and the liquid line can also form a line bundle, for example, by means of a parallel conduction, wherein the steam line and the liquid line can also be designed, for example, as a coaxial line or the like. With particular advantage, however, the steam line and the liquid line are spatially separated from each other.

It is also advantageous if the evaporator has a lower geodetic height position and the condenser has a higher geodetic height position in relation to a mounting position of the headlight in a vehicle. This can make it possible for the cooling medium to circulate automatically in the fluid circuit of the cooling device, so that the evaporated cooling medium can flow from the evaporator into the condenser via the steam line and the condensed cooling medium can flow from the condenser into the evaporator via the liquid line without the necessity for a pump or the like. This automatic flow principle, in particular, is achieved with the cooling device in the form of a thermosiphon.

It is also advantageous if the condenser is arranged outside a housing of the headlight. For example, the condenser can serve as a convection cooler, in that it has a rib structure with cooling fins or the like. The condenser does not have to have a separate fluid volume, and the condenser can continuously connect the steam line and the liquid line, wherein the condenser improves heat dissipation from the fluid line.

Another further advantage is achieved if the semiconductor illuminant is brought into direct contact with the mixture of the first coolant and the second coolant. Particularly, when selecting one or both coolants from the group of perfluorinated chemical compounds, which is derived from ethyl isopropyl ketones, direct fluid contact with the semiconductor illuminant is harmless since such fluids are not electrically conductive and no oxidation processes have an effect on the surface of, for example, a semiconductor illuminant. By means of the direct fluid contact of the coolant with the semiconductor illuminant, an especially good heat transfer from the semiconductor illuminant to the cooling medium is achieved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus, are not limitive of the present invention, and wherein the sole FIGURE schematically shows a headlight according to an exemplary embodiment.

DETAILED DESCRIPTION

The FIGURE schematically shows a headlight 1 with a housing 17, and a semiconductor illuminant 11 is accommodated in the housing 17, which is used, for example, to produce a high beam or a low beam of the headlight 1. The semiconductor illuminant 11 is shown in connection with a heat sink 18, on which the semiconductor illuminant 11 is mounted and the heat sink 18 can, for example, serve as the carrier body of the semiconductor illuminant 11.

The semiconductor illuminant 11 is arranged within an evaporator 12, wherein the schematic view also shows the arrangement of the heat sink 18 within the evaporator 12, and the evaporator 12 is part of a cooling device 10.

Outside the housing 17 of the headlight 1, a condenser 14 is arranged, and the condenser 14 is connected to the evaporator 12 via a steam line 15 and via a liquid line 16, which is spatially separated from the steam line 15 and thus also part of the cooling device 10. The steam line 15 and the liquid line 16 form a closed fluid circuit of the cooling device 10 with the evaporator 12 and the condenser 14, and the fluid circuit is filled with a cooling medium 13, which is in a liquid state from the condenser via the liquid line 16 to the evaporator 12 and flows according to the liquid flow direction 20, and the cooling medium 13 flows from the evaporator 12 to the condenser 14 via the steam line 15 in a gaseous state or in a wet steam state, which is indicated by the steam flow direction 19.

During operation of the semiconductor illuminant 11 within the evaporator 12, the cooling medium 13 evaporates, after initially flowing in a liquid state via the liquid line 16 to the evaporator 12, and the evaporated cooling medium 13 flows via the steam line 15 from the evaporator 12 into the condenser 14, in which the cooling medium 13 is again converted from the gaseous state to the liquid state.

The cooling medium 13 comprises a first coolant 13*a* and a second coolant 13*b*, and both coolants form a mixture that can circulate within the fluid circuit. The first coolant 13*a* has a lower evaporation temperature than the second coolant 13*b*, wherein both coolants 13*a*, 13*b* are also brought into contact with the semiconductor illuminant 11 in such a way, that heat is emitted from the semiconductor illuminant 11 to the coolants 13*a*, 13*b*.

During normal operation of the semiconductor illuminant 11 at an operating temperature, for example 70° C., the evaporation temperature of the first coolant 13*a* can have a value of 65° C., so that during operation of the semiconductor illuminant 11 it is ensured that the first coolant 13*a* evaporates within the evaporator 12. The second coolant 13*b* remains unevaporated. If the operating temperature of the semiconductor illuminant 11 is further increased, for example, by special environmental influences, in particular very high temperatures of the surrounding environment or by solar radiation into the headlight 1, then the temperature of the semiconductor illuminant 11 can rise sharply, for example, up to 120° C. It can thus be provided that the evaporation temperature of the second coolant 13*b* is approximately 115° C., so that, in the case of an already evaporated first coolant 13*a*, the necessary evaporation enthalpy of the second coolant 13*b* can also be used to emit a particularly large amount of heat to the second coolant 13*b* during operation of the semiconductor illuminant 11 at an elevated temperature.

The cooling medium 13 thus can have two evaporation temperatures.

By means of the inventive development of the cooling device 10 with a cooling medium 13, comprising a first coolant 13*a* with a first lower evaporation temperature and a second coolant 13*b* with a higher evaporation temperature, higher operational reliability of a semiconductor illuminant 11, particularly an LED or a laser semiconductor illuminant, within a headlight 1 for a vehicle is achieved.

The invention is not limited in its implementation to the preferred embodiment described above. Rather, a number of variants is conceivable, which make use of the solution shown, even in the case of fundamentally different embodiments. All features and/or advantages arising from the claims, the description or the drawings, including structural details, spatial arrangements and method steps, can be essential to the invention both individually and in a wide variety of combinations.

What is claimed is:

1. A headlight for a vehicle with a cooling device for a semiconductor illuminant, the cooling device comprising:

a fluid circuit with an evaporator, on or in which the semiconductor illuminant is arranged and in which a cooling medium is evaporated; and a condenser in which the cooling medium is condensed, wherein the cooling medium comprises a first coolant having a first evaporation temperature and a second coolant having a second evaporation temperature, the first evaporation temperature being lower than the second evaporation temperature, wherein at least one of the first coolant or the second coolant has a perfluorinated chemical compound which is derived from an ethyl isopropyl ketone, and wherein the first coolant and the second coolant form a mixture.

2. The headlight according to claim 1, wherein the first evaporation temperature of the first coolant lies below a nominal operating temperature of the semiconductor illuminant.

3. The headlight according to claim 1, wherein the second evaporation temperature of the second coolant lies below a damage temperature of the semiconductor illuminant.

4. The headlight according to claim 1, wherein a steam line extends between the evaporator and the condenser, through which the first coolant and the second coolant are conducted from the evaporator to the condenser and wherein a liquid line extends from the condenser to the evaporator through which the first coolant and the second coolant are conducted from the condenser to the evaporator.

5. The headlight according to claim 4, wherein the steam line and the liquid line are formed separately from each other.

6. The headlight according to claim 1, wherein, in relation to an installation position of the headlight in a vehicle, the evaporator has a lower geodetic height position than the condenser, such that an uppermost surface of the evaporator is positioned below a lowermost surface of the condenser.

7. The headlight according to claim 6, wherein the condenser is arranged outside a housing of the headlight.

8. The headlight according to claim 1, wherein the condenser is arranged outside a housing of the headlight.

9. The headlight according to claim 1, wherein the semiconductor illuminant is brought into direct contact with the mixture of the first coolant and the second coolant by being at least partially encapsulated in the mixture.

10. The headlight according to claim 1, wherein both the first coolant and the second coolant have a perfluorinated chemical compound which is derived from an ethyl isopropyl ketone.

* * * * *